US009670024B2

(12) United States Patent
Zhang et al.

(10) Patent No.: US 9,670,024 B2
(45) Date of Patent: Jun. 6, 2017

(54) PAPER MONEY TEMPORARY STORAGE DEVICE AND PAPER MONEY STORAGE METHOD THEREFOR

(71) Applicant: GRG Banking Equipment Co., Ltd., Guangzhou, Guangdong (CN)

(72) Inventors: Tao Zhang, Guangdong (CN); Wenqing Wu, Guangdong (CN); Zhiqiang Sun, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 15/100,756

(22) PCT Filed: Oct. 24, 2014

(86) PCT No.: PCT/CN2014/089380
§ 371 (c)(1),
(2) Date: Jun. 1, 2016

(87) PCT Pub. No.: WO2015/081770
PCT Pub. Date: Jun. 11, 2015

(65) Prior Publication Data

US 2016/0304307 A1 Oct. 20, 2016

(30) Foreign Application Priority Data

Dec. 6, 2013 (CN) ..... 2013 1 0661267

(51) Int. Cl.
*G07F 19/00* (2006.01)
*B65H 29/00* (2006.01)
*B65H 43/00* (2006.01)

(52) U.S. Cl.
CPC ..... *B65H 29/006* (2013.01); *B65H 43/00* (2013.01); *B65H 2301/4191* (2013.01);
(Continued)

(58) Field of Classification Search
CPC .. G07F 19/20; G06Q 20/1085; B65H 29/006; B65H 43/00; B65H 2301/4191;
(Continued)

(56) References Cited

U.S. PATENT DOCUMENTS 8,561,888 B1 * 10/2013 Graef ..... B65H 29/60 235/375
2002/0113160 A1 8/2002 Niioka
(Continued)

FOREIGN PATENT DOCUMENTS

CN 102431813 A 5/2012
CN 102930638 A 2/2013
(Continued)

OTHER PUBLICATIONS

International Search Report for PCT/CN2014/089380, mailed Jan. 30, 2015, ISA/CN.
(Continued)

*Primary Examiner* — Karl D Frech
(74) *Attorney, Agent, or Firm* — Yue Xu; U.S. Fairsky LLP

(57) ABSTRACT

A banknote temporary storage device and a banknote storage method thereof are provided. The banknote storage device includes a signal collecting unit including a coded disk, a coded disk signal sensor and a rubber wheel, where the coded disk and the rubber wheel are arranged between the storage roller and the belt standby roller via a same rotating shaft, and the coiling belt tightly engages with the rubber wheel and drives the rotation of the rubber wheel. The real-time radius of the storage roller or the belt standby roller is obtained and the angular speed of the drive motor can be adjusted according to the real-time radius, thereby ensuring that the coiling belt uniformly moves at the target speed.

7 Claims, 2 Drawing Sheets

(52) U.S. Cl.
CPC ..... *B65H 2511/10* (2013.01); *B65H 2511/14* (2013.01); *B65H 2513/10* (2013.01); *B65H 2513/11* (2013.01); *B65H 2553/51* (2013.01); *B65H 2701/1912* (2013.01)

(58) Field of Classification Search
CPC ..... B65H 2511/10; B65H 2511/14; B65H 2513/10; B65H 2513/11; B65H 2553/51; B65H 2701/1912
USPC ..... 235/379, 375
See application file for complete search history.

(56) References Cited

U.S. PATENT DOCUMENTS

| | | | |
|---|---|---|---|
| 2004/0065744 | A1 | 4/2004 | Shiraishi et al. |
| 2013/0221606 | A1 | 8/2013 | Lai |

FOREIGN PATENT DOCUMENTS

| | | | |
|---|---|---|---|
| CN | 103395654 | A | 11/2013 |
| CN | 103617675 | A | 3/2014 |
| EP | 2922038 | A1 | 9/2015 |
| GB | 2117142 | B | 10/1983 |
| JP | H10181972 | A | 7/1998 |
| WO | 2007068911 | A1 | 6/2007 |

OTHER PUBLICATIONS

European Search Report for 14866849.4-1731/3079128, mailed Mar. 20, 2017.

* cited by examiner

PAPER MONEY TEMPORARY STORAGE DEVICE AND PAPER MONEY STORAGE METHOD THEREFOR

The present application is the national phase of International Application No. PCT/CN2014/089380, titled "PAPER MONEY TEMPORARY STORAGE DEVICE AND PAPER MONEY STORAGE METHOD THEREFOR", filed on Oct. 24, 2014, which claims priority to Chinese patent application NO. 201310661267.0 titled "BANKNOTE TEMPORARY STORAGE DEVICE AND BANKNOTE STORAGE METHOD THEREOF"filed with the Chinese State Intellectual Property Office on Dec. 6, 2013, which is incorporated herein by reference in its entirety.

FIELD

The present disclosure relates to a financial self-service apparatus, particularly to a banknote temporary storage device storing a banknote with a roller and a coiling belt, and a control method for delivering a banknote into or out of the banknote temporary storage device.

BACKGROUND

Presently, a common temporary storage device always uses mechanisms such as rollers and a rolling belt. The storage device includes a storage roller driven by a first drive motor, a belt standby roller driven by a second drive motor and a coiling belt with two ends fixed on the storage roller and the belt standby roller respectively, which is wound around, and is retracted and deployed between the storage roller and the belt standby roller. The first drive motor and the second drive motor are controlled to be started or stopped by a micro controller. This temporary storage device operates in a way that the rollers cooperates with the coiling belt to implement temporary storage of a banknote.

During operation of the temporary storage device, to ensure equally spaced banknotes, it is required to ensure that speeds of different portions of the coiling belt are constant and consistent while the coiling belt is constantly tightened to improve the tenseness of the coiling belt, whereby the storage capacity of the storage roller is improved. According to a principle of circular motion, a linear speed v is equal to an angular speed ω times a radius r. To keep a constant banknote delivering speed, i.e., to keep the linear speeds of the storage roller and the belt standby roller constant, as the coiling belt is deployed and retracted between the storage roller and the belt standby roller, radiuses of the storage roller and the belt standby roller continually change, therefore angular speeds of the first motor and the second motor need to be adjusted timely according to the radiuses of the storage roller and the belt standby roller.

In a conventional method for controlling the temporary storage module, the radius increment ΔX of the storage roller is commonly estimated by using empirical values. The angular speeds of the first motor and the second motor are continuously adjusted according to the estimated radius increment ΔX of the storage roller and the determined radius increment ΔY of the belt standby roller, thereby ensuring that both linear speeds of the storage roller and the belt standby roller are constant and consistent. The radius change ΔX of the storage roller is an estimated value, and the radius change ΔY of the belt standby roller is a determined value setting according to the empirical values, therefore the existing method does not have enough accuracy, so that there is a difference between the linear speed of the storage roller and that of the belt standby roller, which causes loose of the coiling belt and even a cast of the coiling belt.

Besides, the radius of the storage roller is also affected by the thickness of the stored banknote, thus a real-time radius of the storage roller can not be estimated accurately in the conventional technology, and therefore, an accurate angular speed can not be accurately calculated, which can not ensure a constant linear speed of the storage roller. In a case the linear speed of the storage roller has a big difference from that of the belt standby reel, it is apt to cause the following problems: 1, unequal spaces between banknotes on the storage roller, which causes a waste of the coiling belt, reduces the storage capacity of the storage roller, and can not satisfy a design requirement; and 2, loose of the coiling belt and even cast of the coiling belt, which increases a maintenance cost.

SUMMARY

To solve the problem of the loose or cast of the coiling belt caused by the fact that the coiling belt does not has a constant speed due to continually changed diameters of the storage roller and the belt standby roller, a banknote temporary storage device with a function of adjusting a rotating speed of a drive motor in real time is provided according to the present disclosure, which ensures a constant linear speed of the coiling belt.

A method for storing a banknote by a banknote temporary storage device is provided according to the present disclosure, which includes steps of delivering (storing) the banknote into and delivering (releasing) the banknote out of the banknote temporary storage device, and can adjust an angular speed of a drive motor in real time when each banknote enters or leaves the banknote temporary storage device, thereby ensuring a constant linear speed.

The banknote temporary storage device includes a storage roller driven by a first drive motor, a belt standby roller driven by a second drive motor and a coiling belt with two ends fixed on the storage roller and the belt standby roller respectively, which is wound around, and is retracted and deployed between the storage roller and the belt standby roller. The banknote temporary storage device further includes: a first sensor, arranged at an inlet of the banknote temporary storage device and configured to detect whether a banknote enters the banknote temporary storage device; a second sensor, arranged between the first sensor and the storage roller and configured to detect whether the banknote leaves the banknote temporary storage device; a signal collecting unit, which includes a coded disk, a coded disk signal sensor and a rubber wheel, where the coded disk and the rubber wheel are arranged between the storage roller and the belt standby roller via a same rotating shaft, and the coiling belt tightly engages with the rubber wheel and drives the rotation of the rubber wheel; and a control system, which includes a central processing unit, a calculation unit, a data storage unit and a drive control unit, where the calculation unit is configured to calculate radiuses of the rollers and rotating speeds of the drive motors, the data storage unit is configured to store real-time radiuses of the storage roller and the belt standby roller at an end of an operation of the banknote temporary storage device, for use when a next operation of the banknote temporary storage device is started, the drive control unit is configured to control rotating speeds of the first drive motor and the second drive motor in real time, and the central processing unit is configured to coordinate the units of the banknote temporary storage device to control the operation of the banknote temporary storage device.

The method for storing a banknote by a banknote temporary storage device includes steps 1 to 5. Step 1 includes starting a banknote temporary storage device, reading from a data storage unit parameters recorded at an end of a last operation of the banknote temporary storage device, where the parameters include a radius $R_{record}$ of the storage roller and a radius $r_{record}$ of the belt standby roller, and calculating a rotating speed for starting a first drive motor of the banknote temporary storage device. Step 2 includes detecting by a first photoelectric sensor whether a banknote enters the banknote temporary storage device, controlling the first drive motor to rotate at the rotating speed calculated in step 1 if the banknote enters the banknote temporary storage device, starting the signal collecting unit when the first drive motor rotates at a constant speed, detecting a coded disk signal with the coded signal sensor, recording the number N of generated pulses and a period Δt of time for generating the N pulses, calculating, with a known number M of pulses generated by the coded disk during one turn and a known diameter D of the rubber wheel which is coaxial with the coded disk and tightly engages with the coiling belt, a moving distance L of the coiling belt during the period Δt of time according to the formula $L=(N/M)*\pi D$ (it is required that N is recorded when the first drive motor rotates at the constant speed, and N is smaller than 3 times M), and calculating a real-time linear speed $V_{real\text{-}time}$ of the coiling belt when each banknote enters the banknote temporary storage device according to the formula $V_{real\text{-}time}=L/\Delta t$. Step 3 includes calculating, with a known current rotating speed W of the storage roller, a real-time radius $R_{real\text{-}time}$ according to the circular motion principle $R_{real\text{-}time}=V_{real\text{-}time}/W$, and calculating, with a known target speed $V_{target}$ to which the speed of the coiling belt needs to be adjusted, a rotating speed $W_{adjusted}$ to which the rotating speed of the first drive motor needs to be adjusted according to the formula $W_{adjusted}=V_{target}/R_{real\text{-}time}$, to ensure that the coiling belt uniformly moves at the target speed $V_{target}$ when the banknote enters the banknote temporary storage device. Step 4 includes repeating steps 2 and 3, to adjust the rotating speed of the first drive motor when each banknote enters the banknote temporary storage device in real time and ensure that the coiling belt moves at the target speed $V_{target}$. Step 5 includes resetting the coiling belt after storing all banknotes to be stored, measuring a real-time radius r of the belt standby roller and storing a real-time radius R of the storage roller and the real-time radius r of the belt standby roller into the data storage unit, for use when a next operation of the banknote temporary storage device is started.

Preferably, in steps 2 to 4, while the first drive motor is rotating, the second drive motor is in a braking state and the coiling belt is tightened by a load of the banknote temporary storage device and a braking torque of the second drive motor.

Specially, the process of measuring a real-time radius r of the belt standby roller in step 5 includes: starting the second drive motor with a predetermined rotating speed w after a portion of the coiling belt is retracted by the storage roller, such that the belt standby roller retracts the coiling belt, and stopping the second drive motor when the second sensor detects a banknote, to prevent the banknote from leaving the banknote temporary storage device; during the process that the second drive motor rotates and stops rotation after reaching a constant speed, recording the number n of pulses generated by the coded disk, recording a period $\Delta t_1$ of time of the process, and calculating a moving distance $L_1$ of the coiling belt during the process that the belt standby roller rotates for the period $\Delta t_1$ of time according to the formula: $L_1=(n/M)*\pi Dc$; calculating a real-time linear speed v of the coiling belt according to the formula: $v=L_1/\Delta t_1$; and calculating a real-time radius r of the belt standby roller according to the formula: $r=v/w$.

The method for storing a banknote by a banknote temporary storage device further includes a method for delivering the banknote out of the banknote temporary storage device. The method for delivering a banknote out of the banknote temporary storage device includes steps 6 to 10. Step 6 includes starting the banknote temporary storage device, reading the parameters recorded in step 5, where the parameters include the radius R of the storage roller and the radius r of the belt standby roller, and calculating a rotating speed for starting the second drive motor of the banknote temporary storage device. Step 7 includes detecting by a second photoelectric sensor whether a banknote leaves the banknote temporary storage device, controlling the second drive motor to rotate at the rotating speed calculated in step 6 if the banknote leaves the banknote temporary storage device, detecting a coded disk signal generated by the coded signal sensor when the second drive motor rotates at a constant rotating speed, recording the number $n_1$ of generated pulses and a period $\Delta t_2$ of time for generating the $n_1$ pulses, calculating, with a known number M of pulses generated by the coded disk during one turn and a known diameter D of the rubber wheel which is coaxial with the coded disk and tightly engages with the coiling belt, a moving distance $L_2$ of the coiling belt during the period $\Delta t_2$ of time according to the formula $L_2=(n_1/M)*\pi D$ (it is required that $n_1$ is recorded when the first drive motor rotates at the constant speed, and since the first drive motor may stop rotation when each banknote enters the banknote temporary storage device, $n_1$ can not have a large value and is smaller than 3 times M; and $n_1$ is not associated with M and may be not equal to M), and calculating a real-time speed $v_1$ of the coiling belt when each banknote leaves the banknote temporary storage device according to the formula $v_1=L_2/\Delta t_2$. Step 8 includes calculating, with a known current rotating speed $w_1$ of the belt standby roller, a real-time radius $r_1$ of the belt standby roller according to the circular motion principle $r_1=v_1/w_1$, and calculating, with a known target speed $V_{target}$ to which the speed of the coiling belt needs to be adjusted, a rotating speed $w_{adjusted}$ to which the rotating speed of the second drive motor needs to be adjusted according to the formula $w_{adjusted}=V_{target}/r_1$, to ensure that the coiling belt uniformly moves at the target speed $V_{target}$ when the banknote leaves the banknote temporary storage device. Step 9 includes repeating steps 7 and 8, to adjust the rotating speed of the second drive motor when each banknote leaves the banknote temporary storage device in real time and to ensure that the moving speed of the coiling belt is the target speed $V_{target}$. Step 10 includes resetting the coiling belt after all banknotes to be released leave the banknote temporary storage device, measuring the real-time radius $R_1$ of the belt standby roller and storing the real-time radius $R_1$ of the storage roller and the real-time radius $r_1$ of the belt standby roller into the data storage unit, for use when a next operation of the banknote temporary storage device is started.

Preferably, in steps 7 to 9, while the second drive motor is rotating, the first drive motor of the banknote temporary storage roller is drived in a braking state and the coiling belt is tightened by a load of the banknote temporary storage device and a braking torque of the first drive motor.

Preferably, the process of measuring the real-time radius $R_1$ of the storage roller in step 10 includes: starting, by the belt standby roller, the first drive motor with a predetermined rotating speed $W_{start}$ to retract a portion of the coiling belt; starting recording the number of pulses generated by the coded disk when the first drive motor reaches a constant speed, recording the number N1 of pulses generated by the coded disk and a period $\Delta t_3$ of time before the second drive motor stops rotation, and calculating a moving distance $L_3$ of the coiling belt during the process that the banknote temporary storage roller rotates for the period $\Delta t_3$ of time according to the formula: $L_3=(N_1/M)*\pi D$; calculating the real-time linear speed $V_1$ of the coiling belt according to the formula $V_1=L_3/\Delta t_3$; and calculating the real-time radius $R_1$ of the storage roller according to the formula $R_1=V_3/W_{start}$.

The banknote temporary storage device according to the present disclosure includes a signal collecting unit, and ingeniously use structures of the rubber wheel which is coaxial with the coded disk and tightly engages with the coiling belt, the coded disk and the coded disk signal sensor, so that the number of rotation turns of the rubber wheel is obtained by recording the number of rotation turns of the coded disk, the real-time speed of the coiling belt when each banknote enters or leaves the banknote temporary storage roller is calculated, the real-time radius of the storage roller or the belt standby roller is obtained, and the angular speed of the drive motor can be adjusted according to the real-time radius, thereby ensuring that the coiling belt uniformly moves at the target speed.

The method for storing a banknote by a banknote temporary storage device according to the present disclosure includes steps of delivering the banknote into and out of the banknote temporary storage device. The real-time radius of the storage roller or the belt standby roller is calculated when each banknote enters or leaves the banknote temporary storage device, thereby adjusting a rotating speed of a drive motor in real time based on the real-time radius, to control a rotating speed of the storage roller or the belt standby roller and thereby achieving a constant linear speed of the coiling belt.

DETAILED DESCRIPTION

To further illustrate the banknote temporary storage device according to the present disclosure, the embodiments of the disclosure are described in detail in conjunction with drawings.

Figure 1:
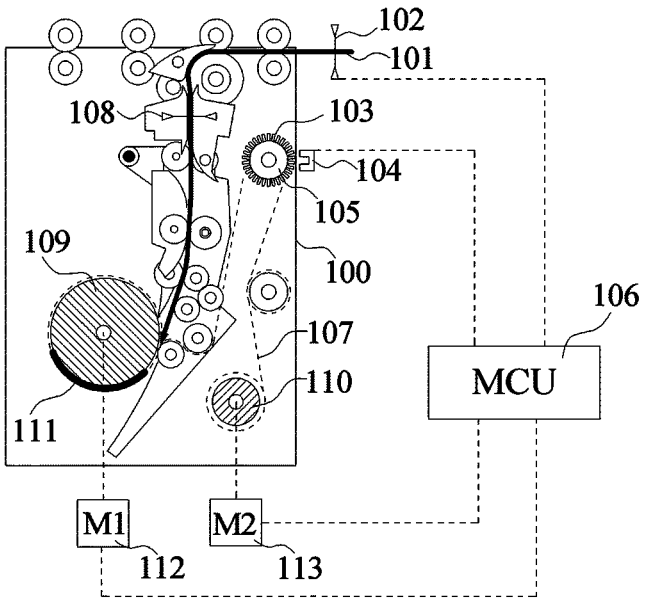
FIG. 1 is a lateral view of a banknote temporary storage device according to a preferred embodiment of the disclosure.

FIG. 1 is a lateral view of an internal structure of a banknote temporary storage device 100 according to a preferred embodiment of the disclosure. The banknote temporary storage device 100 includes a first sensor 102, a second sensor 108, a storage roller 109, a belt standby roller 110, a coiling belt 107, a transmission path 101, a first drive motor 112, a second drive motor 113, a micro controller 106, and a signal collecting unit which includes a coded disk 103, a coded disk signal sensor 104 and a rubber wheel 105.

The micro controller 106 controls the first drive motor 112 and the second drive motor 113. The first drive motor 112 drives the storage roller 109, and the second drive motor 103 drives the belt standby roller 110. Two ends of the coiling belt 107 are fixed to the storage roller 109 and the belt standby roller 110 respectively. The coiling belt 107 is wound around, and is deployed and retracted between the storage roller 109 and the belt standby roller 110. A banknote 111 enters the banknote temporary storage device 100 through the transmission path 101, and is stored on the storage roller via the coiling belt 107. The first sensor 102 is arranged at an inlet of the banknote temporary storage device, and is configured to detect whether the banknote 111 enters the banknote temporary storage device 100. The second sensor 108 is arranged between the first sensor and the storage roller, and is configured to detect whether the banknote leaves the banknote temporary storage device 100.

Figure 2:
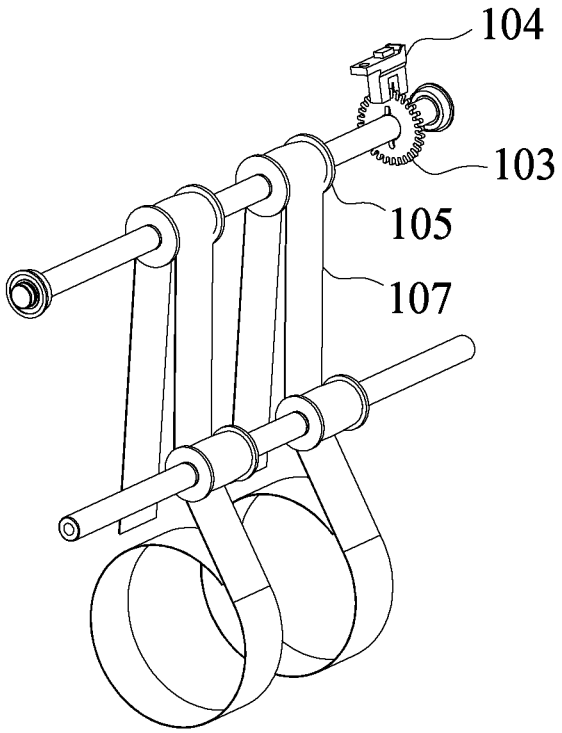
FIG. 2 is a stereogram of a signal collecting unit of a banknote temporary storage device.

As shown in FIG. 2, the coded disk 103 and the rubber wheel 105 are arranged between the storage roller 109 and the belt standby roller 110 via a same rotating shaft, and the coiling belt 107 tightly engages with the rubber wheel 105 and drives the rotation of the rubber wheel 105. When the coiling belt 107 drives the rotation of the rubber wheel 105, the coded disk signal sensor 104 detects the number of pulses generated by the coded disk 103. Since the coiling belt 107 tightly engages with the rubber wheel 105, the coiling belt 107 does not slip with the rubber wheel 105.

The micro controller 106 is a control system included in the banknote temporary storage device 100. The control system includes a central processing unit, a calculation unit, a data storage unit and a drive control unit. The calculation unit is configured to calculate radiuses of the rollers and rotating speeds of the drive motors, the data storage unit is configured to store real-time radiuses of the storage roller and the belt standby roller at an end of an operation of the banknote temporary storage device, for use when a next operation of the banknote temporary storage device is started, the drive control unit is configured to control rotating speeds of the first drive motor and the second drive motor in real time, and the central processing unit is configured to coordinate the units of the banknote temporary storage device to control the operation of the banknote temporary storage device.

Preferably, the signal collecting unit may include a first collecting unit and a second collecting unit. The first collecting unit is configured to collect the number of pulses generated by the coded disk 103 and a period of time spent on the generation of the pluses when a real-time radius of the storage roller 109 is calculated, and the second collecting unit is configured to collect the number of pulses generated by the coded disk 103 and a period of time spent on the generation of the pluses when a real-time radius of the belt standby roller 110 is calculated.

A control method for storing a banknote into a temporary storage device is described in conjunction with FIGS. 1 and 2.

When a banknote 111 is deliver into the banknote temporary storage device 100, the storage roller 109 retracts the coiling belt 107 actively and the belt standby roller 110 deploys the coiling belt 107 in a braking manner.

Before the banknote temporary storage device 100 operates, the micro controller 106 reads a current initial radius $R_{record}$ of the storage roller 109 from the data storage unit, and calculates an initial rotating speed $W_{initial}$ of the two rollers according a target speed $V_{target}$:

$$W_{initial}=V_{target}/R_{record}.$$

The first drive motor 112 is started with the initial rotating speed W when the first photoelectric sensor 102 detects that the banknote 111 enters the banknote temporary storage device.

When the first drive motor 112 operates at a constant speed, the coded disk signal sensor 104 detects a signal of the coded disk 103. The micro controller 106 records the number $N_{in}$ of generated pulses and a period $\Delta t_{in}$ of time for generating the $N_{in}$ pulses. With a known constant number M of pulses generated by the coded disk 103 during one turn and a known constant diameter D of the rubber wheel 105, a moving distance $L_{in}$ of the coiling belt 107 during the period $\Delta t_{in}$ of time can be calculated according to the formula: $L_{in}=(N_{in}/M)*\pi D$.

Thus, a real-time linear speed $V_{real\text{-}time}$ of the coiling belt 107 can be calculated when each banknote 111 enters the banknote temporary storage device 100:

$$V_{real\text{-}time}=L_{in}/\Delta t_{in}.$$

With a known current rotating speed $W_{current}$ of the storage roller 109 (when the first banknote enters the banknote temporary storage device 100, the speed of the storage roller 109 is an initial speed $W_{initial}$), a real-time radius $R_{real\text{-}time}$ can be calculated according to the formula: $R_{real\text{-}time}=V_{real\text{-}time}/W_{current}$.

With a known target speed $V_{target}$ to be adjusted, a rotating speed $W_{adjusted}$ to which the speed of the storage roller needs to be adjusted can be calculated according to the following formula:

$$W_{adjust}=V_{target}/R_{real\text{-}time}.$$

With the method above, the rotating speed of the storage roller 109 is adjusted each time when the banknote 111 enters the banknote temporary storage device 100, so that the linear speed of the coiling belt is always the target speed $V_{target}$ as the radius of the storage roller 109 changes.

During the process that the banknote 111 enters the banknote temporary storage device 100, the belt standby roller is in a braking state, to tighten the coiling belt 107.

A method for measuring a real-time radius $r_{real\text{-}time}$ of the belt standby roller 100 after the process of that the banknote 111 enters the banknote temporary storage device 100 is finished is described hereinafter. The method is as follows.

After the storage roller 109 retracts a portion of the coiling belt 107, the second drive motor 113 is started with a predetermined rotating speed $w_{start}$ such that the belt standby roller 110 retracts the coiling belt 107. When the second sensor detects the banknote 111, the second drive motor stops running to prevent the banknote 111 from leaving the banknote temporary storage device 100.

During the process that the second drive motor 113 rotates and stops rotation after reaching a constant speed, the number $n_{in}$ of pulses generated by the coded disk is recorded, a period $\Delta t_{in1}$ of time for the process is recorded, and a moving distance $L_{in1}$ of the coiling belt 107 during the process that that the belt standby roller 110 rotates for the period $\Delta t_{in1}$ of time can be calculated according to the formula: $L_{in1}=(n_{in}/M)*\pi D$;

a real-time linear speed $v_{real\text{-}time}$ of the coiling belt is further calculated according to the formula: $v_{real\text{-}time}=L_{in1}/\Delta t_{in1}$;

and a real-time radius $r_{real\text{-}time}$ of the belt standby roller is further calculated according to the formula: $r_{real\text{-}time}=v_{real\text{-}time}/w_{start}$.

When the banknote temporary storage device 100 stops operation, the current real-time radius $R_{real\text{-}time}$ of the storage roller and the current real-time radius $r_{real\text{-}time}$ of the belt standby roller are stored in the data storage unit, for use when a next operation of the banknote temporary storage device 100 is started.

A principle for controlling the banknote temporary storage device 100 to deliver the banknote 111 out of the banknote temporary storage device 100 is described hereinafter.

When the banknote 111 is delivered out of the banknote temporary storage device 100, the belt standby roller 110 retracts the coiling belt 107 actively and the storage roller 109 retracts the coiling belt 107 in a braking manner.

Before the banknote temporary storage device 100 operates, the micro controller 106 reads a current initial radius $r_{record}$ of the belt standby roller 110 from the data storage unit, and calculates an initial rotating speed $w_{initial}$ of the belt standby roller according to the target speed $V_{target}$: $w_{initial}=V_{target}/r_{record}$.

During the process that the banknote 111 is delivered out of the banknote temporary storage device 100, when the second drive motor 113 reaches a constant speed, the coded disk signal sensor 104 detects a signal of the coded disk 103. The number $n_{out}$ of generated pulses and a period $\Delta t_{out}$ of time for generating the $n_{out}$ pulses are recorded. With the known number M of pulses generated by the coded disk 103 during one turn and a known diameter D of the rubber wheel 105 which is coaxial with the coded disk 103 and tightly engages with the coiling belt 107, a moving distance $L_{out}$ of the coiling belt 107 during the period $\Delta t_{out}$ of time can be calculated according to the formula: $L_{out}=(n_{out}/M)*\pi D$.

Thus, a real-time linear speed $v_{real\text{-}time\ out}$ of the coiling belt 107 can be calculated when the banknote 111 leaves the banknote temporary storage device 100 according to the formula: $V_{real\text{-}time\ out}=L_{out}/\Delta t_{out}$.

With a known current rotating speed $w_{current}$ of the belt standby roller 110 (when the first banknote enters the banknote temporary storage device 100, the speed of the storage roller 109 is an initial speed $W_{initial}$), a real-time radius $r_{real\text{-}time\ out}$ can be calculated according to the formula: $r_{real\text{-}time\ out}=v_{real\text{-}time\ out}/w_{current}$.

With the known target speed $V_{target}$ to which the speed of the belt standby roller needs to be adjusted, a rotating speed $w_{adjusted}$ to which the rotating speed of the belt standby roller 110 needs to be adjusted can be calculated according to the following formula:

$$w_{adjusted}=V_{target}/r_{real\text{-}time\ out}.$$

With the method above, the rotating speed of the storage roller 109 is adjusted each time when a banknote leaves the banknote temporary storage device 100, so that the linear speed of the coiling belt is always the target speed $V_{target}$ as the radius of the roller changes.

When the banknote 111 is delivered out of the banknote temporary storage device 100, the storage roller 109 is in a braking state, to tighten the coiling belt 107.

A method for measuring a real-time radius $R_{real\text{-}time\ out}$ of the storage roller 109 after the banknote 111 leaves the banknote temporary storage device 100 is described hereinafter.

The first drive motor 112 is started with a predetermined rotating speed $W_{start}$ to drive the storage roller 109 to retract a portion of the coiling belt 107. When the first drive motor reaches a constant speed, a number $N_{out}$ of pulses generated by the coded disk 103 is recorded, and a period $\Delta t_{out1}$ of time for generating the pulses is recorded. A moving distance $L_{out1}$ of the coiling belt 107 during the period $\Delta t_{out1}$ of time that the storage roller 109 rotates can be calculated according to the formula: $L_{out1}=(N_{out}/M)*\pi D$;

A real-time linear speed $V_{real\text{-}time\ out}$ of the coiling belt 107 is further calculated according to the formula: $V_{real\text{-}time\ out}=L_{out1}/\Delta t_{out1}$.

A real-time radius $R_{real\text{-}time\ out}$ of the storage roller 109 is further calculated according to the formula: $R_{real\text{-}time\ out}=V_{real\text{-}time\ out}/W_{start}$.

When the banknote temporary storage device 100 stops operation, the current real-time radius $R_{real\text{-}time\ out}$ of the storage roller and the current real-time radius $r_{real\text{-}time\ out}$ of the belt standby roller 110 are stored in the data storage unit, for use when a next operation of the banknote temporary storage device 100 is started.

In the method for storing a banknote by a banknote temporary storage device according to the embodiment, the banknote is delivered into the banknote temporary storage device and delivered out of the banknote temporary storage device, the real-time radius of the storage roller or the belt standby roller can be calculated when each banknote enters or leaves the banknote temporary storage device, so that the rotating speed of the drive motor is adjusted based on the real-time radius, to control the rotating speed of the storage roller or the belt standby roller, thereby achieving a constant speed of the coiling belt.

The foregoing embodiments are only preferred embodiments of the disclosure. It should be noted that the preferred embodiments according to the disclosure are not intended to limit the disclosure. The scope of the disclosure is subject to the scope of the claims. Those of skills in the art may make some variations and improvements on the technical solutions of the disclosure without departing from the spirit and scope of the technical solutions. All simple variations and improvements made without departing from spirit and scope of the technical solutions of the disclosure fall in the scope of the technical solutions of the disclosure.

The invention claimed is:

1. A banknote temporary storage device, comprising a storage roller driven by a first drive motor, a belt standby roller driven by a second drive motor and a coiling belt with two ends fixed on the storage roller and the belt standby roller respectively, the coiling belt being wound around the storage roller and the belt standby roller, and being retracted and deployed between the storage roller and the belt standby roller, wherein, the banknote temporary storage device further comprises:

a first sensor, arranged at an inlet of the banknote temporary storage device and configured to detect whether a banknote enters the banknote temporary storage device;

a second sensor, arranged between the first sensor and the storage roller and configured to detect whether the banknote leaves the banknote temporary storage device;

a signal collecting unit, comprising a coded disk, a coded disk signal sensor and a rubber wheel, wherein the coded disk and the rubber wheel are arranged between the storage roller and the belt standby roller via a same rotating shaft and the coiling belt tightly engages with the rubber wheel and drives the rotation of the rubber wheel; and a control system, comprising a central processing unit, a calculation unit, a data storage unit and a drive control unit, wherein the calculation unit is configured to calculate radiuses of the rollers and rotating speeds of the drive motors, the data storage unit is configured to store real-time radiuses of the storage roller and the belt standby roller at an end of an operation of the banknote temporary storage device, for use when a next operation of the banknote temporary storage device is started, the drive control unit is configured to control rotating speeds of the first drive motor and the second drive motor in real time, and the central processing unit is configured to coordinate the units of the banknote temporary storage device to control the operation of the banknote temporary storage device.

2. A method for storing a banknote by a banknote temporary storage device, comprising:

step 1 which comprises starting a banknote temporary storage device, reading, from a data storage unit, parameters recorded at an end of a last operation of the banknote temporary storage device, wherein the parameters comprises a radius $R_{record}$ of the storage roller and a radius $r_{record}$ of the belt standby roller, and calculating a rotating speed for starting a first drive motor of the banknote temporary storage device;

step 2 which comprises detecting by a first photoelectric sensor whether a banknote enters the banknote temporary storage device, controlling the first drive motor to rotate at the rotating speed calculated in step 1 if the banknote enters the banknote temporary storage device, starting the signal collecting unit when the first drive motor rotates at a constant speed, detecting a coded disk signal with the coded signal sensor, recording the number N of generated pulses and a period $\Delta t$ of time for generating the N pulses, calculating, with a known number M of pulses generated by the coded disk during one turn and a known diameter D of the rubber wheel which is coaxial with the coded disk and tightly engages with the coiling belt, a moving distance L of the coiling belt during the period $\Delta t$ of time according to the formula $L=(N/M)*\pi D$ (it is required that N is recorded when the first drive motor rotates at the constant speed, and N is smaller than 3 times M), and calculating a real-time linear speed $V_{real\text{-}time}$ of the coiling belt when each banknote enters the banknote temporary storage device according to the formula $V_{real\text{-}time}=L/\Delta t$;

step 3 which comprises calculating, with a known current rotating speed W of the storage roller, a real-time radius $R_{real\text{-}time}$ according to the circular motion principle $R_{real\text{-}time}=V_{real\text{-}time}/W$, and calculating, with a known target speed $V_{target}$ to which the speed of the coiling belt needs to be adjusted, a rotating speed $W_{adjusted}$ to which the rotating speed of the first drive motor needs to be adjusted according to the formula $W_{adjusted}=V_{target}/R_{real\text{-}time}$, to ensure that the coiling belt uniformly moves at the target speed $V_{target}$ when the banknote enters the banknote temporary storage device;

step 4 which comprises repeating steps 2 and 3, to adjust the rotating speed of the first drive motor when each banknote enters the banknote temporary storage device in real time and ensure that the coiling belt moves at the target speed $V_{target}$; and step 5 which comprises resetting the coiling belt after storing all banknotes to be stored, measuring a real-time radius r of the belt standby roller and storing a real-time radius R of the storage roller and the real-time radius r of the belt standby roller into the data storage unit, for use when a next operation of the banknote temporary storage device is started.

3. The method for storing a banknote by a banknote temporary storage device according to claim 2, wherein, in steps 2 to 4, while the first drive motor is rotating, the second drive motor is in a braking state and the coiling belt is tightened by a load of the banknote temporary storage device and a braking torque of the second drive motor.

4. The method for storing a banknote by a banknote temporary storage device according to claim 3, wherein, the process of measuring a real-time radius r of the belt standby roller in step 5 comprises:

starting the second drive motor with a predetermined rotating speed w after a portion of the coiling belt is retracted by the storage roller, such that the belt standby roller retracts the coiling belt, and stopping the second drive motor when the second sensor detects a banknote, to prevent the banknote from leaving the banknote temporary storage device;

during the process that the second drive motor rotates and stops rotation after reaching a constant speed, recording the number n of pulses generated by the coded disk, recording a period $\Delta t_1$ of time of the process, and calculating a moving distance $L_1$ of the coiling belt during the process that the belt standby roller rotates for the period $\Delta t_1$ of time according to the formula: $L_1=(n/M)*\pi D$;

calculating a real-time linear speed v of the coiling belt according to the formula: $v=L_1/\Delta t_1$; and calculating a real-time radius r of the belt standby roller according to the formula: $r=v/w$.

5. The method for storing a banknote by a banknote temporary storage device according to claim 2, further comprising a method for delivering the banknote out of the banknote temporary storage device, wherein the method for delivering the banknote out of the banknote temporary storage device comprises:

step 6 which comprises starting the banknote temporary storage device, reading the parameters recorded in step 5, wherein the parameters comprise the radius R of the storage roller and the radius r of the belt standby roller, and calculating a rotating speed for starting the second drive motor of the banknote temporary storage device;

step 7 which comprises detecting by a second photoelectric sensor whether a banknote leaves the banknote temporary storage device, controlling the second drive motor to rotate at the rotating speed calculated in step 6 if the banknote leaves the banknote temporary storage device, detecting a coded disk signal generated by the coded signal sensor when the second drive motor rotates at a constant rotating speed, recording the number $n_1$ of generated pulses and a period $\Delta t_2$ of time for generating the $n_1$ pulses, calculating, with a known number M of pulses generated by the coded disk during one turn and a known diameter D of the rubber wheel which is coaxial with the coded disk and tightly engages with the coiling belt, a moving distance $L_2$ of the coiling belt during the period $\Delta t_2$ of time according to the formula:

$L_2=(n_1/M)*\pi D$, (it is required that $n_1$ is recorded when the first drive motor rotates at the constant speed, and since the first drive motor may stop rotation when each banknote enters the banknote temporary storage device, $n_1$ can not have a large value and is smaller than 3 times M; and $n_1$ is not associated with M and may be not equal to M), and calculating a real-time speed $v_1$ of the coiling belt when each banknote leaves the banknote temporary storage device according to the formula $v_1=L_2/\Delta t_2$;

step 8 which comprises calculating, with a known current rotating speed $w_1$ of the belt standby roller, a real-time radius $r_1$ of the belt standby roller according to the circular motion principle $r_1=v_1/w_1$, and calculating, with a known target speed $V_{target}$ to which the speed of the coiling belt needs to be adjusted, a rotating speed $w_{adjusted}$ to which the rotating speed of the second drive motor needs to be adjusted according to the formula $w_{adjusted}=V_{target}/r_1$, to ensure that the coiling belt uniformly moves at the target speed $V_{target}$ when the banknote leaves the banknote temporary storage device;

step 9 which comprises repeating steps 7 and 8, to adjust the rotating speed of the second drive motor when each banknote leaves the banknote temporary storage device in real time and to ensure that the moving speed of the coiling belt is the target speed $V_{target}$; and step 10 which comprises resetting the coiling belt after all banknotes to be released leave the banknote temporary storage device, measuring the real-time radius $R_1$ of the belt standby roller and storing the real-time radius $R_1$ of the storage roller and the real-time radius $r_1$ of the belt standby roller into the data storage unit, for use when a next operation of the banknote temporary storage device is started.

6. The method for storing a banknote by a banknote temporary storage device according to claim 5, wherein, in steps 7 to 9, while the second drive motor is rotating, the first drive motor is drived in a braking state and the coiling belt is tightened by a load of the banknote temporary storage device and a braking torque of the first drive motor.

7. The method for storing a banknote by a banknote temporary storage device according to claim 6, wherein, the process of measuring a real-time radius $R_1$ of the storage roller in step 10 comprises:

starting, by the belt standby roller, the first drive motor with a predetermined rotating speed $W_{start}$ to retract a portion of the coiling belt; starting recording the number of pulses generated by the coded disk when the first drive motor reaches a constant speed, recording the number N1 of pulses generated by the coded disk and a period $\Delta t_3$ of time before the second drive motor stops rotation, and calculating a moving distance $L_3$ of the coiling belt during the process that the banknote temporary storage roller rotates for the period $\Delta t_3$ of time according to the formula: $L_3=(N_1/M)*\pi D$;

calculating the real-time linear speed $V_1$ of the coiling belt according to the formula $V_1=L_3/\Delta t_3$; and calculating the real-time radius $R_1$ of the storage roller according to the formula $R_1=V_3/W_{start}$.

* * * * *